US005141845A

United States Patent [19]

Brugger et al.

[11] Patent Number: 5,141,845

[45] Date of Patent: Aug. 25, 1992

[54] PROCESS FOR THE SPECTRAL SENSITIZATION OF PHOTOGRAPHIC SILVER HALIDE EMULSIONS AND PRODUCTS THEREOF

[75] Inventors: Pierre A. Brugger, Village Amont Fribourg; Rolf Steiger, Fribourg, both of Switzerland

[73] Assignee: Ilford Limited, Knutsford, England

[21] Appl. No.: 607,560

[22] Filed: Oct. 31, 1990

[30] Foreign Application Priority Data

Nov. 14, 1989 [GB] United Kingdom ..... 8925678

[51] Int. Cl.[5] ..... G03C 1/015; G03C 1/12

[52] U.S. Cl. ..... 430/569; 430/570; 430/583; 430/584; 430/587

[58] Field of Search ..... 430/569, 583, 584, 587, 430/570

[56] References Cited

U.S. PATENT DOCUMENTS 4,225,666 9/1980 Locker et al. ..... 430/569
4,623,612 11/1986 Nishikawa et al. ..... 430/375
4,741,995 5/1988 Tani et al. ..... 430/558

*Primary Examiner*—Charles L. Bowers, Jr.
*Assistant Examiner*—Janet C. Baxter
*Attorney, Agent, or Firm*—Darby & Darby

[57] ABSTRACT

There is described a process for the spectral sensitization of photographic silver halide emulsions which comprises forming and chemically sensitizing silver halide crystals in a colloid dispersion medium, the process being characterized in that it comprises forming a shell of silver halide on the chemically sensitized crystals by simultaneously adding to the dispersion an aqueous solution of a water soluble halide or pseudo-halide, an aqueous solution of silver nitrate and a J-band aggregating spectral sensitizing dye in an aqueous medium, the said simultaneous additions being continued for sufficient time to form a shell of silver halide or pseudo-halide on the said chemically sensitized silver halide crystals which is up to 15 mole percent of the total silver halide or pseudo-halide of the fully grown crystals.

It is thought that in the process of the present invention there is formed on the surface of the chemically sensitized silver halide crystal terraces of the halide or pseudo-halide being added, these terraces being separated from each other by steps of high surface energy. The J-band aggregating dye nucleates on these steps and is deterred from recombining. At the end of the process frequently the whole surface of the silver halide crystals is coverd with such terraces and steps on which the J-band dyes have nucleated. When such crystals are photo exposed, electron hole recombination is decreased leading to higher photographic speed and low LIRF.

7 Claims, No Drawings

PROCESS FOR THE SPECTRAL SENSITIZATION OF PHOTOGRAPHIC SILVER HALIDE EMULSIONS AND PRODUCTS THEREOF

The present invention relates to a process of spectral sensitisation of photographic silver halide emulsions and photographic materials containing these emulsions.

It is conventional practice to adsorb the spectral sensitiser at the surface of the silver halide crystals after chemical sensitisation. However, other techniques are also known. Locker et al U.S. Pat. No. 4,225,666 discloses spectral sensitisation during precipitation of silver halide after nucleation has occurred and before completion of silver halide precipitation. Syun et al EU Patent 0,069,596 discloses adding a first sensitising dye during chemical sensitisation of the silver halide emulsion and a second sensitising dye after chemical sensitisation.

We have now found that spectral sensitisation and especially Low Intensity Reciprocity Failure (LIRF) can be improved by adsorbing the sensitising dye during concurrent growth of a shell onto the chemically sensitised silver halide crystals.

According to the present invention there is provided a process for the spectral sensitisation of photographic silver halide emulsions which comprises forming in and chemically sensitising silver halide crystals in a colloid dispersion medium to form a core, the process being characterised in that it comprises forming a shell of silver halide on the chemically sensitised crystals by simultaneously adding to the dispersion an aqueous solution of a water soluble halide or pseudo-halide, an aqueous solution of silver nitrate and a J-band aggregating spectral sensitising dye in an aqueous medium, the said simultaneous additions being continued for sufficient time to form a shell of silver halide or pseudo-halide on the said chemically sensitised silver halide crystals which is up to 15 mole percent of the total silver halide or pseudo-halide of the fully grown crystals.

By pseudo-halide is meant an anion which forms an insoluble silver salt which can co-precipitate with a water-soluble halide and which can react with silver nitrate to form water-insoluble crystals or parts of a crystal. In the photographic system a pseudo-halide acts in a similar manner to a halide and can be used to replace or partially replace a halide.

Examples of pseudo-halides are alkali metal (preferably sodium or potassium) or ammonium thiocyanate, or alkali metal (preferably sodium or potassium) or ammonium cyanide.

The preferred pseudo-halides for use in the process of the present invention are alkali metal thiocyanates, preferably sodium thiocyanate or potassium thiocyanate.

By chemically sensitised is meant the increase in light-sensitivity of the silver halide crystals by the action of certain chemicals such as reducing agents, gold and sulphur compounds. A description of chemical sensitisation is given in the Theory of the Photographic Process by James, 4th Edition (pages 149–158).

The preferred chemical sensitisation for the emulsions of the present invention is a combination of sulphur and gold sensitisation.

By J-Band aggregating dyes are meant cyanine dyes which self-aggregate producing shifts to longer wavelength and sharper absorption curves than the non-aggregated dyes. Such J-band aggregation is described in The Theory of the Photographic Process by James, 4th Edition, 1977 at pages 218–222.

In the process of the present invention the J-Band aggregating dyes are added to the colloid dispersion either as an aqueous solution or as a dispersion in an aqueous medium.

In the process of the present invention there are simultaneously added silver nitrate solution, an alkali metal or ammonium halide or pseudo-halide solution and a solution or dispersion of a J-aggregating sensitising dye under controlled pAg conditions to the chemically sensitised silver halide crystals in a colloid dispersing medium.

The silver halide emulsion used in the present invention can be comprised of silver bromide, silver chloride, silver chlorobromide, silver chloroiodide, silver bromoiodide, silver chlorobromoiodide or mixtures thereof. The emulsions can include coarse, medium or fine silver halide grains and they may have regularly shaped, for example, cubic or octahedral, crystals, or they may have irregularly shaped, for example, spherical or tabular, crystals. Alternatively, the crystals may be combinations of these shapes. The grains may be a mixture of ones having various crystal shapes. The grains may have different phases between the interior and the surface, or they may possess a uniform phase.

The photographic emulsion of the present invention can be prepared by any of the methods described in P Glafkides, "Chimie et Physique Photographique", Paul Montel, 1967, G F Duffin "Photographic Emulsion Chemistry", The Focal Press, 1966 and V L Zelikman et al "Making and Coating Photographic Emulsions", The Focal Press, 1964. That is, the emulsion may be prepared by an acid process, neutral process or ammonia process. The "controlled double-jet method" wherein the solution for forming silver halide grains is kept at a constant level of pAg is preferably used as this method is effective for producing a silver halide emulsion comprising grains of a substantially uniform size having regular crystal shapes.

Other methods for the preparation of silver halide emulsions which can be used for the present invention are described, for example, in Research Disclosure No 17643, December 1978, RD No 22534, January 1983 and RD No 23212, August 1983.

For the chemical sensitisation any of the known procedures can be used, for example procedures which are described in RD No 17643, December 1978, and No 22534, January 1983 and in H Friester, "Die Grundlagen der Photographischem Prozesse mit Silberhalogeniden" pages 675,734 (Akademische Verlags Gesellschaft 1968).

More specifically, sulphur sensitisation methods using active gelatin, and compounds containing sulphur capable of reacting with silver ions (e.g. thiosulphates, thioureas, mercapto compounds, and thiocyanates), reduction sensitisation methods using reducing materials (e.g. stannous salts, amines, hydrazine derivatives, foramidine sulphinic acid and silane compounds), noble metal sensitisation methods using noble metal compounds (e.g. gold compounds, and complex salts of Group VIII metals such as platinum, iridium and palladium) and so on can be employed independently or in combination. One preferred sensitisation technique employs thiosulphate as the sulphur sensitiser and gold.

Shelling of the emulsions is carried out according to known methods. The chemically sensitised emulsion is brought into contact with conventional silver salt precipitation solutions. Typically the precipitation solution includes a silver salt and an alkali metal halide or an alkali metal thiocyanate which interact in a double decomposition reaction to form the silver halide and an alkali metal salt by-product which remains in solution.

Addition of the precipitating solutions is done by double jet technique, keeping constant the pAg-value within the emulsion. Concurrently with the precipitation solutions a solution of an J-aggregating sensitising dye is added.

During additional silver salt precipitation a peptiser, such as gelatin or some other conventional hydrophilic colloid may be added.

The shell on the chemically sensitised silver halide crystals prepared in the process of the present invention can be for example silver chloride, silver bromide, silver iodobromide and especially silver thiocyanate.

The thickness of the shell formed can be up to 15 mole % by weight of the total weight of the silver halide in the crystal. Preferably the thickness of the shell is between 2 and 10 mole % of the silver halide in the crystal.

The time taken for the addition of the solutions is not critical, but one has to ensure that all additional silver salt is laid down on the surface of the silver halide crystals and no new stable nuclei are formed separately and the addition rate should be slow enough that the spectral sensitiser can adsorb on the continuously enlarging surface of the crystal. The addition rate can be constant, or can increase stepwise or gradually with time. Good results can be obtained with addition times between 5 and 60 minutes, but the time can even be longer.

Usually the solution or dispersion of the J-aggregating sensitising dyes is added concurrently and within the same time as the precipitating solutions but the introduction of the spectral sensitising dye can start before addition of the precipitating solutions or can be delayed until about 20% of the precipitating solutions have been added.

Water miscible solvents are usually present in the aqueous solution of the J-aggregating sensitising dyes such as methanol, ethanol and acetone to help in the dissolution of the dye.

J-aggregating sensitising dyes, useful for the present invention can be represented by formula:

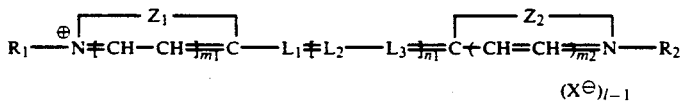

(I)

wherein $R_1$ and $R_2$ each independently represents an alkyl-or aryl group or a substituted alkyl-or aryl group, $L_1$, $L_2$ and $L_3$ each independently represents a methine group or a substituted methine group. $Z_1$ and $Z_2$ each independently is an atom or a group of atoms necessary to complete a 5- or 6- membered heterocyclic ring, $m_1$ and $m_2$ each independently is 0 or 1, $n_1$ is 0, 1 or 2 and X represents an anion, 1 is 1 or 2 provided that 1 is 1 when (I) forms an inner salt.

Preferred cyanine dyes which can be used in the present invention are, for example:

(1)

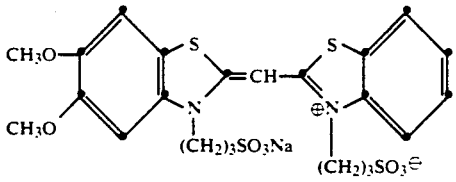

(2)

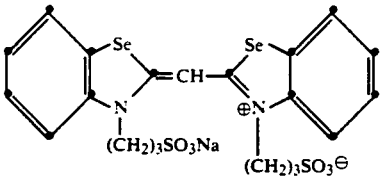

(3)

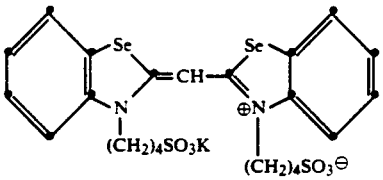

(4)

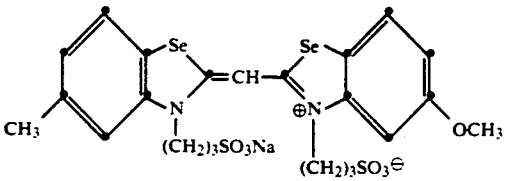

-continued
(5)
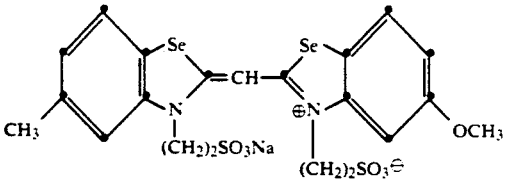
(6)
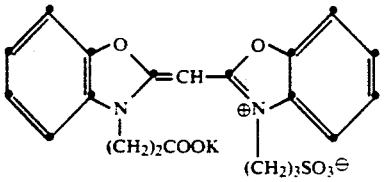
(7)
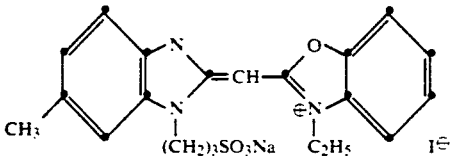
(8)
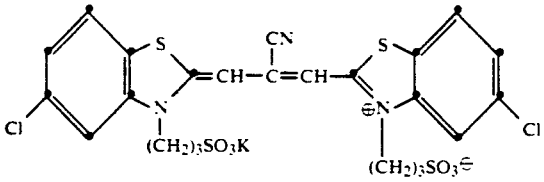
(9)
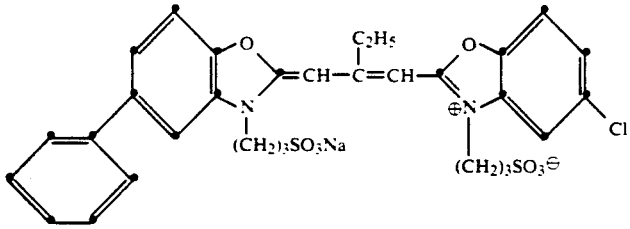
(10)
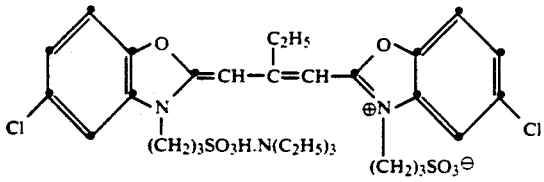
(11)
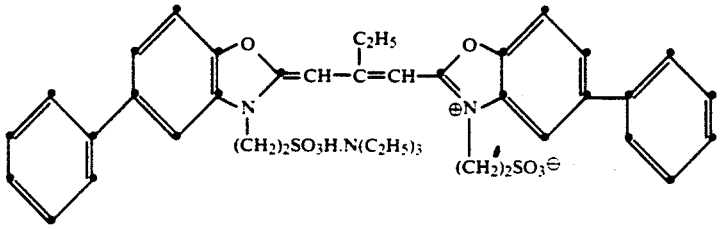

-continued
(12)
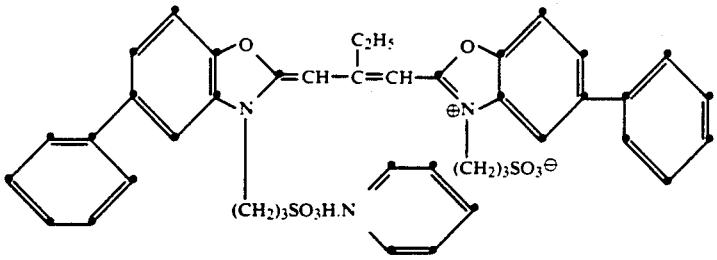
(12a)
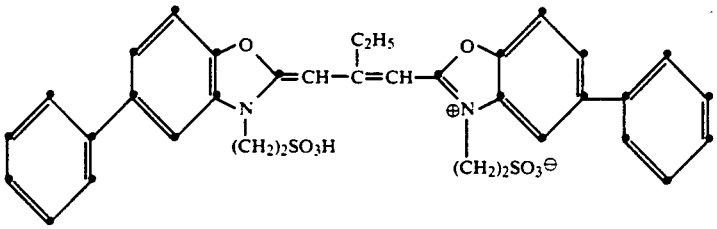
(13)
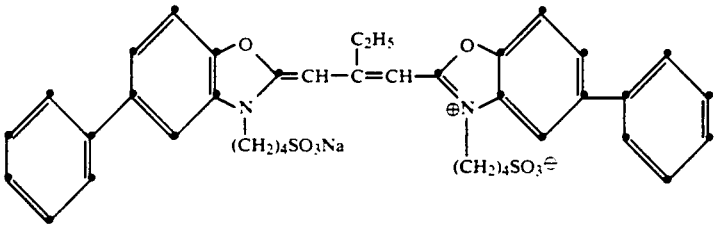
(14)
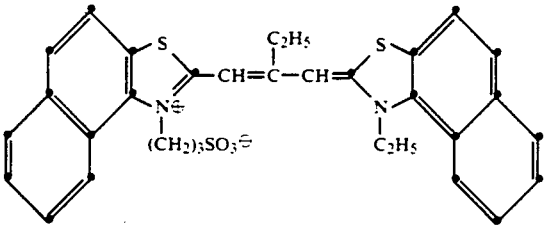
(15)
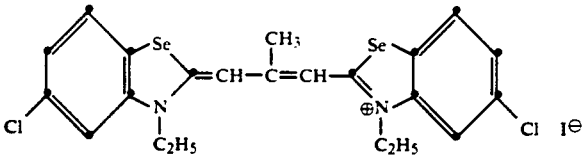
(16)
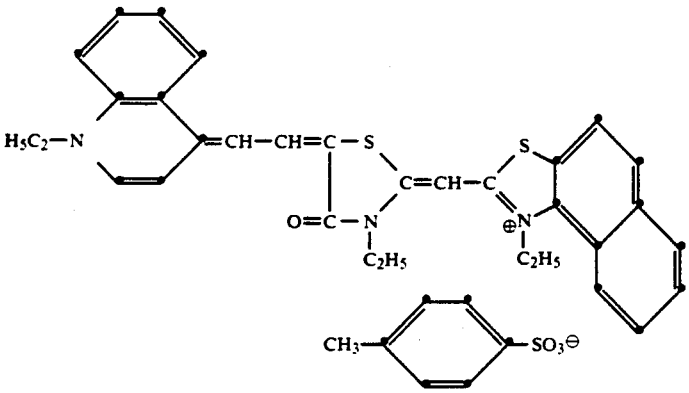

-continued
(17)
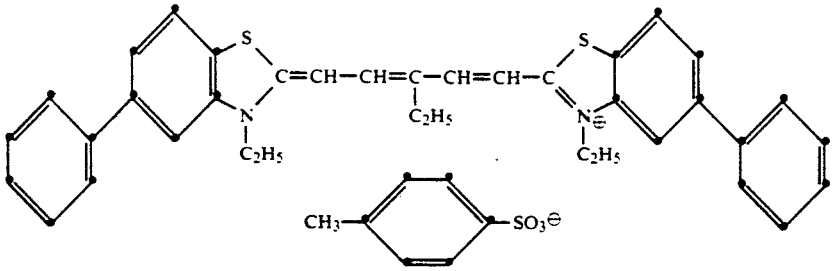
(18)
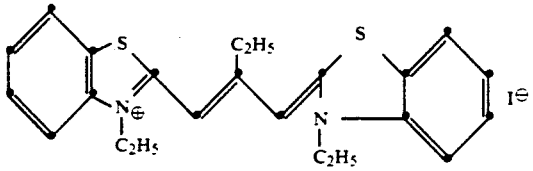
(19)
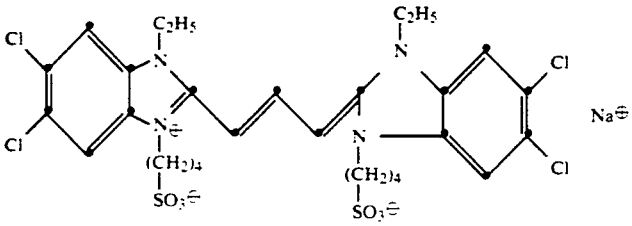
(20)
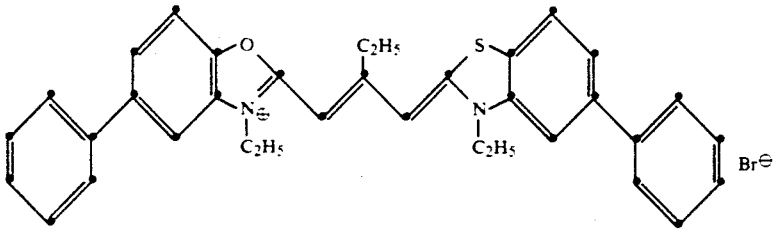
(21)
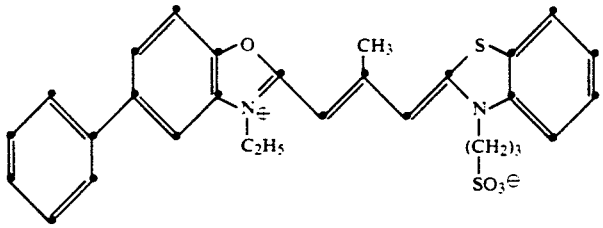
(22)
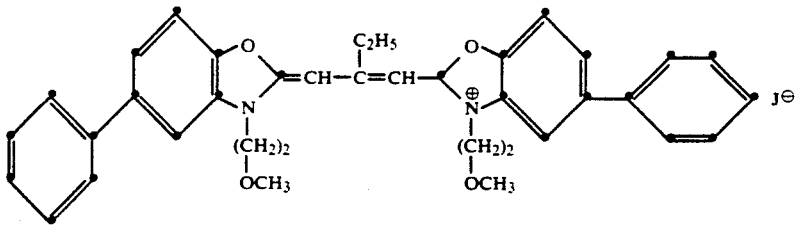
(23)
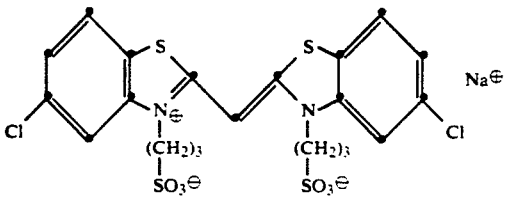

-continued
(24)
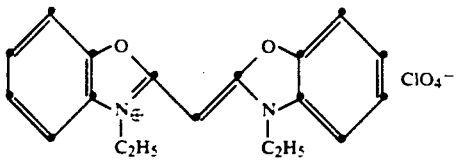
(25)
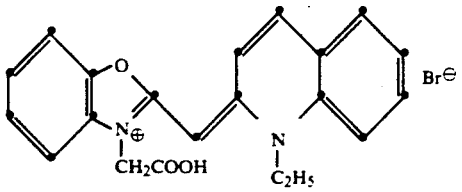
(26)
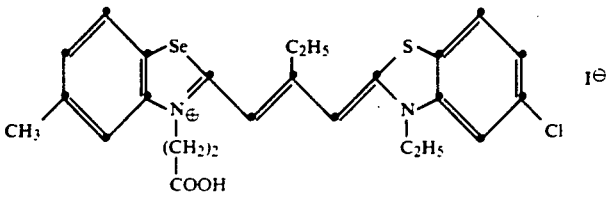
(27)
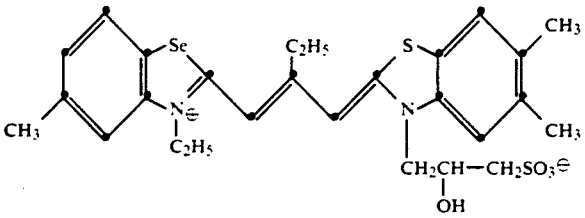
(27a)
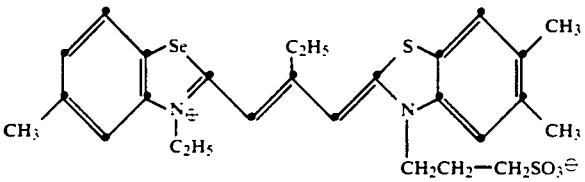
(28)
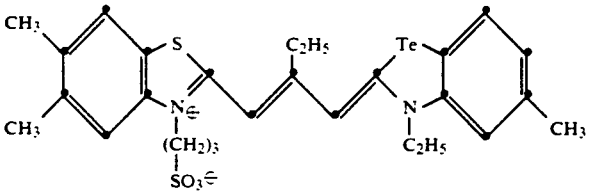
(29)
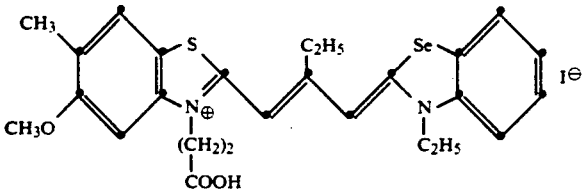
(30)
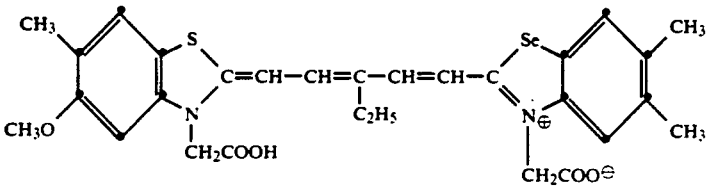
Silver halide emulsions prepared according to the present invention show very low "Low Intensity Reci- Photographic material of the present invention comprises, in at least one layer, one or more silver halide emulsions spectrally sensitised with a J-aggregating dye according to the present invention.

The spectrally sensitised silver halide of the present invention and the photographic light sensitive material using the same may contain other compounds, such as azo dyes, colour couplers, optical brightening agents, UV-absorbers, filter dyes, stain inhibitors stabilisers, hardeners, coating aids and antistatic agents. Such additives are described for example in RD No 17643, December 1978.

The finished emulsion may be coated on an appropriate support such as baryta paper, resin-coated paper, synthetic paper, triacetate film, polyethylene terephthalate film or a glass plate. Various coating methods, including dip coating methods, an air knife coating, cascade coating, curtain coating and an extrusion coating method can be employed.

Such a support may be either transparent or opaque depending upon the intended use of the light sensitive material. When a support used is transparent, it can be colourless or coloured by addition of a dye or a pigment.

Photographic light sensitive materials to which the emulsion of the present invention can be applied include various colour and black and white photosensitive materials. Specific examples of such materials include colour negative films (for amateur use, motion picture use, etc), colour reversal films (for slide use, motion picture use, etc), colour photographic papers, colour positive films (for motion picture use, etc) colour reversal photographic papers, heat-developable colour photosensitize materials, colour photosensitive materials for a silver dye bleach process, photographic light-sensitive materials for a photomechanical process (lith films, scanner films, etc), X-ray photographic light sensitive materials (for medical use employing radiography or fluorography, for industrial use etc), black and white negative films, black and white photographic papers, microphotographic light sensitive materials (COM, microfilms, etc) colour diffusion transfer photosensitive materials (DTR), silver salt diffusion transfer photosensitive materials and printout photosensitive materials.

In the photographic processing of a photosensitive material to which the silver halide emulsion prepared in accordance with the present invention is applied, any known processing method and any known processing solution can be employed. The processing temperature is generally in the range of about 18° C. to about 50° C. Of course, temperatures lower than about 18° C. or higher than about 50° C. may be employed. The photographic processing may include either development processing for forming a silver image (black and white photographic processing) or development processing for forming a dye image (colour photographic processing).

It is thought that in the process of the present invention there is formed on the surface of the chemically sensitised silver halide crystals terraces of the halide or pseudo-halide being added, these terraces being separated from each other by steps of high surface energy. The J-band aggregating dye nucleates on these steps and is deterred from recombining. At the end of the process frequently the whole surface of the silver halide crystals is covered with such terraces and steps on which the J-band dyes have nucleated. When such crystals are photo exposed, electron hole recombination is decreased leading to higher photographic speed and low LIRF.

Preferably when the emulsions of the present invention are present in a photographic assembly which has been photographically exposed the assembly is developed in a solvent developer. By solvent developer is meant a developer which comprises a proportion of a silver halide solvent and thus is able to develop an internal latent image in the silver halide crystals Examples of useful silver halide solvent are thiosulphates and thiocyanates.

The following examples will serve to illustrate the invention.

EXAMPLE 1

The following solutions are prepared:

| | |
|---|---|
| Solution A | |
| Phthalated gelatin | 18 g |
| Potassium bromide | 196 g |
| Potassium iodide | 124 g |
| Distilled water | 2790 ml |
| Solution B | |
| Silver nitrate | 102 g |
| Distilled water | 1000 ml |
| Solution C | |
| Silver nitrate | 153 g |
| Distilled water | 1500 ml |
| Solution D | |
| Gelatin | 183 g |
| Distilled water | 2130 ml |

Solution A is placed in a reaction vessel equipped with a mechanical stirrer, heated to 66° C. and adjusted to a pH value of 6.0. Solution B with a temperature of 57° C. is added to Solution A under stirring within 30 seconds. Then Solution C is introduced into the reaction vessel in 25 minutes. The emulsion produced is cooled to 35° C. and coagulated by lowering the pH to 3.5. After decanting the supernatant liquid the coagulum is washed with 500 ml of water. The coagulum is then dispersed in Solution D at 40° C. and pH 6.0, pAg 8.8. The silver halide crystals are polydispersed with a crystal volume between 0.29 $\mu m^3$ and 0.37 $\mu m^3$.

The emulsion is chemically sensitised to optimum speed with 12$\mu$ moles $Na_2S_2O_3$, 18$\mu$ moles $HAuCl_4$, 1.1 m moles $NH_4SCN$ and 4.8 mg of the potassium salt of p-toluene thiosulphonate per mole of silver halide by digestion during 50 minutes at 55° C.

This is an emulsion containing chemically sensitised silver halide crystals. This emulsion is used for spectral sensitisation according to the present invention by adding 2 mg of the sensitising dye of formula (12 a) per g of silver in different ways.

1.1 (Comparative example). The solution of the sensitising dye is added to the emulsion in one lot and mixture is held at 40° C. for 60 minutes.

1.2 (Comparative example). The solution of the sensitising dye is added to the emulsion. After 60 minutes at 40° C. a shell of silver bromide crystals is precipitated onto the silver halide crystals by adding concurrently 225 ml of a 0.1 molar silver nitrate and 225 ml of a 0.1 molar potassium bromide solution. This addition is carried out over a period of 60 minutes, while maintaining a constant pAg of 8.2 and a temperature of 40° C. The amount of added silver halide corresponds to 1.5 mole % of the total silver halide.

1.3 (Comparative example). The silver halide crystals are first shelled with 15 m moles of silver bromide per one mole of silver halide by adding within a period of 60 minutes 0.1 molar solutions of silver nitrate and potassium bromide while maintaining a constant pAg of 8.2 and a temperature of 40° C. Then the solution of the sensitising dye is added and the mixture kept at 40° C. for 60 minutes.

1.4 (Example according to the present invention). 2000 g of the emulsion, containing 1 mole of silver are heated to 40° C. With continuous stirring 150 ml of 0.1 molar silver nitrate solution, 150 ml of 0.1 molar potassium bromide solution and 216 g of a 0.1% solution of the sensitising dye of formula (12 a) in ethanol are added at a constant rate over a period of 60 minutes while maintaining a constant pAg of 8.2 and a temperature of 40° C.

1.5 The procedure of 1.4 is repeated except that the addition of the solution of sensitising dye (12 a) starts 15 minutes before the addition of silver nitrate—and potassium bromide solution.

1.6 The procedure of 1.4 is repeated except that the addition of the solution of sensitising dye (12 a) starts 15 minutes after the addition of silver nitrate and potassium bromide solution.

The thus prepared emulsions 1 to 6 are coated on a transparent polyester film with a coating weight of 2.65 g silver per $m^2$, exposed behind a step-wedge and then processed as follows:

| | |
|---|---|
| Development | 1.5 minutes |
| Washing | 0.5 minutes |
| Fixing | 1.5 minutes |
| Washing | 3.0 minutes |
| Drying | |

The temperature of each of the baths used is 30° C. The developing bath contains the following components per liter of solution:

| | |
|---|---|
| Sodium sulphite | 38.0 g |
| Potassium sulphite | 19.9 g |
| Lithium sulphite | 0.6 g |
| 1-phenyl-3-pyrazolidinone | 0.5 g |
| Hydroquinone | 8.0 g |
| Potassium carbonate | 19.5 g |
| Potassium bicarbonate | 13.3 g |
| Potassium bromide | 3.5 g |
| Benzotriazole | 1.0 g |
| Sodium thiosulphate | 0.9 g |
| Sodium ethylenediamine tetraacetate | 4.0 g |

The fixing bath contains, per liter of solution:

| | |
|---|---|
| Ammonium thiosulphate | 200 g |
| Ammonium bisulphate | 12 g |
| Ammonium sulphite | 39 g |

The evaluation of exposed and coated emulsions gives the values shown in Table 1.

TABLE 1

| EMULSION NUMBER | LOG S (X) | LIRF (XX) |
|---|---|---|
| 1.1 (COMPARISON) | −0.86 | −0.58 |
| 1.2 (COMPARISON) | −0.77 | −0.41 |
| 1.3 (COMPARISON) | −0.71 | −0.41 |
| 1.4 | −0.71 | −0.34 |
| 1.5 | −0.75 | −0.35 |

TABLE 1-continued

| EMULSION NUMBER | LOG S (X) | LIRF (XX) |
|---|---|---|
| 1.6 | −0.71 | −0.22 |

(X) Log S = log sensitivity at 0.1 above fog for 1 sec exposure time.
(XX) LIRF = log S (1 sec exposure) - log S (512 sec exposure).

EXAMPLE 2

Variation of the Composition of the Shell

The same emulsion is used as in Example 1. As described in Example 1.4 the solutions of sensitising dye, silver nitrate and alkali halide or thiocyanate are added to the emulsions concurrently, within 60 minutes, keeping constant the temperature at 40° C. and the pAg at 8.2.

The amount of precipitated silver salt is 1.5 mole % of the total silver. The nature of the precipitated silver salt is shown in Table 2, together with the sensitometric results obtained after coating and processing as described in Example 1.

TABLE 2

| COMPOSITION OF THE SHELL | LOG S | LIRF |
|---|---|---|
| AgCl | −0.86 | −0.41 |
| AgBr | −0.82 | −0.22 |
| $AgBr_{0.95}I_{0.05}$ | −0.87 | −0.21 |
| AgSCN | −0.72 | −0.22 |
| Without Shell (comparison) | −0.89 | −0.58 |

EXAMPLE 3

Variation of the Shell Thickness

The same emulsion is used as in Example 1. The procedure of Example 1.4 is repeated but the amounts of silver nitrate and potassium bromide added concurrently with the solution of the sensitising dye are varied. The amounts are given in Table 3, together with the sensitometric results after coating and processing as described in Example 1.

TABLE 3

| MOLE % AgBr PRECIPITATED (AS PERCENTAGE OF THE SILVER HALIDE CRYSTALS) | LOG S | LIRF |
|---|---|---|
| 0 (COMPARISON) | −0.89 | −0.58 |
| 1.5 | −0.82 | −0.23 |
| 3.0 | −0.81 | −0.19 |
| 4.5 | −0.72 | −0.17 |

EXAMPLE 4

Variation of Addition Rate

The procedure of Example 1.4 is repeated but the time in which the different solutions are added is varied. Table 4 shows precipitation times and sensitometric results obtained after coating and processing as described in Example 1.

TABLE 4

| TIME OF ADDITION | LOG S | LIRF |
|---|---|---|
| 20 min | −0.76 | −0.41 |
| 60 min | −0.71 | −0.35 |
| 180 min | −0.71 | −0.27 |

EXAMPLE 5

Sensitisation With Red Sensitising Dye 2000 g of the emulsion of Example 1 are heated to 40° C. The pAg is adjusted to 8.7. With continuous stirring 300 ml of a solution containing 0.1 molar of $AgNO_3$, 300 ml of a solution containing 29.3 m moles of KBr and 0.7 m moles of KI and 292 ml of a 0.1% solution of the sensitising dye of formula (27) in n-propanol/water (1+1) are added simultaneously with constant rate, within 60 minutes, keeping constant the pAg of 8.7 and the temperature of 40° C.

For comparison a second emulsion is spectrally sensitised by adding the solution of the sensitising dye and keeping the mixture at 40° C. for 60 minutes without precipitation of silver halide.

Both emulsions are coated and processed as described in Example 1. The sensitometric results are given in Table 5.

TABLE 5

| EMULSION | LOG S | LIRF |
|---|---|---|
| 1 | −1.10 | −0.22 |
| 2 (COMPARISON) | −1.00 | −0.55 |

EXAMPLE 6

Sensitisation of a Pure AgBr Emulsion With Blue Sensitising Dye

A pure silver bromide polydispersed tabular emulsion with a mean grain volume of 0.36 $um^3$ and an aspect ratio of 8:1 is prepared and desalted in the usual manner. For chemical sensitisation per mole of silver halide are added: 14 u moles of $(NH_4)_2S_2O_3$, 10 u moles of $HAuCl_4$, 0.63 m moles of $NH_4SCN$ and 0.9 mg of the potassium salt of p-toluene thiosulphonate. The emulsion is then adjusted to pH 7.0 and pAg 8.7, heated to 55° C. and kept at this temperature for 40 minutes.

2000 g of this emulsion, containing 1 mole of silver are heated to 40° C. With continuous stirring 150 ml of 0.3 molar silver nitrate solution, 150 ml of 0.3 molar potassium bromide solution and 540 ml of a 0.1% solution of the sensitising dye of formula (23) dissolved in a mixture of n-propanol/water (1+1) are added simultaneously with constant rate within 60 minutes maintaining a constant pAg of 8.7 and temperature of 40° C.

For comparison a second emulsion is spectrally sensitised by adding the solution of the sensitising dye and keeping the mixture at 40° for 60 minutes without precipitation of silver halide.

Both emulsion are coated and processed as described in Example 1. The sensitometric results are given in Table 6.

TABLE 6

| EMULSION | LOG S | LIRF |
|---|---|---|
| 1 | −0.42 | −0.19 |
| 2 (COMPARISON) | −0.50 | −0.45 |

EXAMPLE 7

Sensitisation of a Monosized Silver Bromide Emulsion

A monosized silver bromide emulsion with cubic crystals, having an average edge lenth of 0,45 μm with a standard deviation of ±0,015 μm was prepared. The emulsion, containing one mole of silver per kg and 7% gelatin was chemically sensitised to optimum speed with 20μ moles of $Na_2S_2O_3$ and 5μ moles of H Au $Cl_4$ per mole silver halide by digestion at pH 7,0 and pAg 8,2 for 30 minutes at 60° C.

2500 g of this emulsion was heated to 40° C. With continous stirring 400 ml of 0,5 molar silver nitrate solution and 400 ml of 0,5 molar potasium bromide solution are added simultaneously at a constant rate within 45 minutes maintaining a constant pAg-value of 6,8 and a temperature of 40° C.

10 minutes after starting the addition of the silver nitrate solution 405 g of a 0,2% solution of the sensitising dye of formula (12 a) in methanol was added concurrently with constant rate within 35 minutes.

For comparison a second part of the emulsion was spectrally sensitised by adding the solution of the sensitising dye and keeping the mixture at 40° for 45 minutes without simultaneous precipitation of silver halide.

Both emulsions are coated and processed as described in Example 1. The sensitometric results are given in Table 7.

TABLE 7

| Emulsion | Log S | LIRF |
|---|---|---|
| 1 | -0,47 | -0,25 |
| 2 | -0,55 | -0,64 |

(Definition of Log S and LIRF is given page 21 (end of Table 1))

We claim as our invention:

1. A process for the spectral sensitisation of photographic silver halide emulsions which comprises forming and chemically sensitising silver halide crystals in a colloid dispersion medium to form a core, and forming a shell of silver halide on the chemically sensitised core by simultaneously adding to the dispersion an aqueous solution of water soluble halide or pseudo-halide, an aqueous solution of silver nitrate and at least one J-band aggregating spectral sensitising dye in an aqueous medium, the said simultaneous additions being continued for sufficient time to form a shell of silver halide crystals which is up to 15 mole percent of the total silver halide or pseudo-halide of the fully grown crystals.

2. A process according to claim 1 wherein the said simultaneous additions are continued for sufficient time to form a shell of silver halide crystals which is from 2 to 10 mole percent of the total silver halide or pseudo-halide of the fully grown crystals.

3. A process according to claim 1 wherein the pseudo-halide is an alkali metal thiocyanate.

4. A process according to claim 2 wherein the pseudo-halide is an alkali metal thiocyanate.

5. A process according to claim 1 wherein the silver halide cores have been both gold and sulphur sensitised.

6. A process according to claim 1 wherein the J-band aggregating spectral sensitising dye is a dye of the formula:

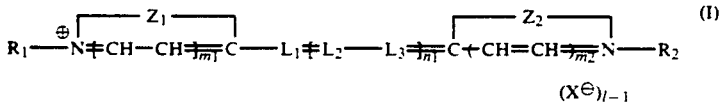

(I)

wherein $R_1$ and $R_2$ each independently represents an alkyl- or aryl group or a substituted alkyl- or aryl group, $L_1$, $L_2$ and $L_3$ each independently represents a methene group or substituted methene group, $Z_1$ and $Z_2$ each independently is an atom or a group of atoms necessary to complete a 5- or 6- membered heterocyclic ring, $m_1$ and $m_2$ each independently is 0 or 1, $n_1$ is 0, 1 or 2 and X represents an anion, 1 is 1 or 2 provided that 1 is 1 when (I) forms an inner salt.

7. A process according to claim 6 wherein the sensitizing dye is at least one of the dyes (1)–(30) below:

(1)

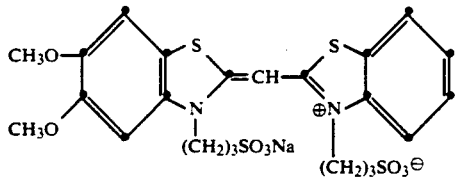

(2)

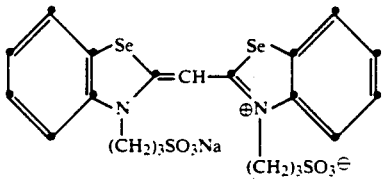

(3)

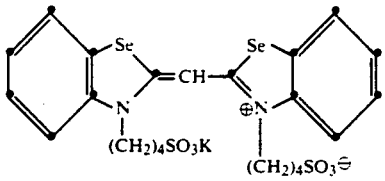

(4)

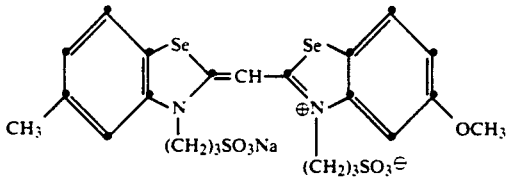

(5)

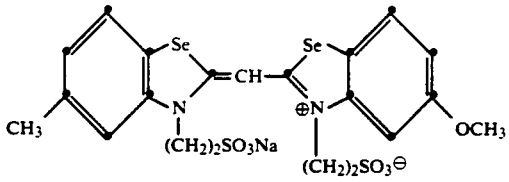

(6)

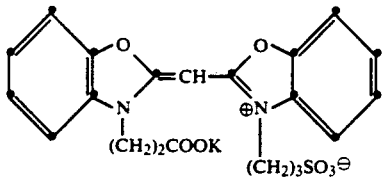

(7)

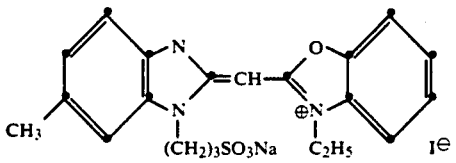

-continued
(8)
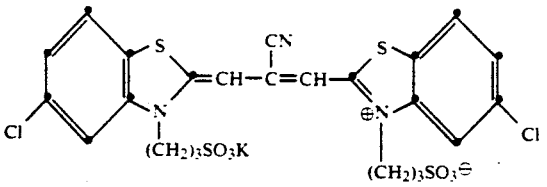
(9)
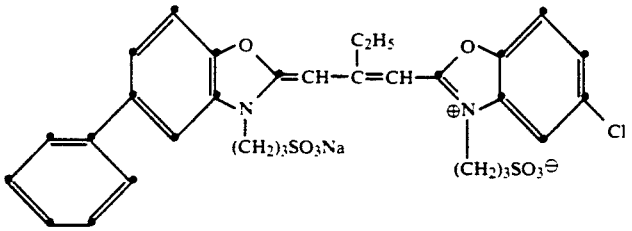
(10)
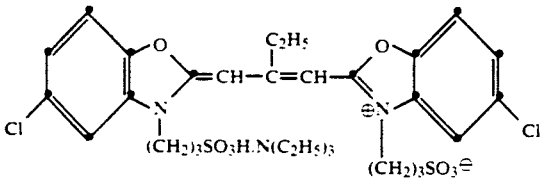
(11)
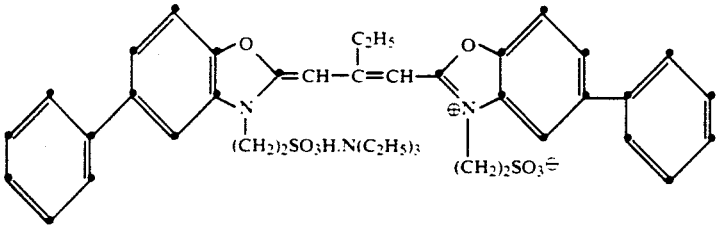
(12)
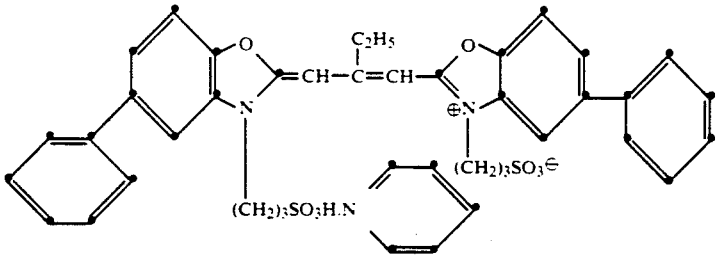
(12a)
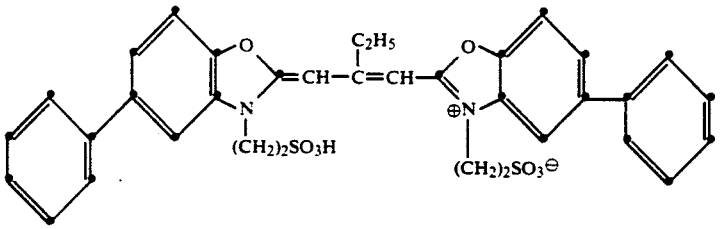
(13)
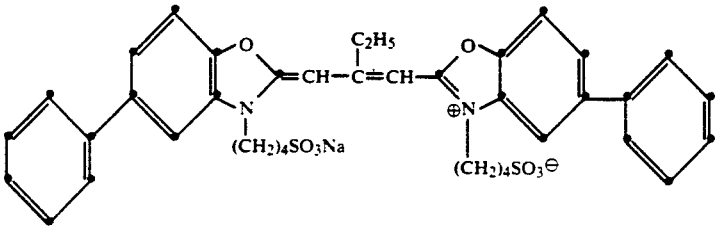

-continued
(14)
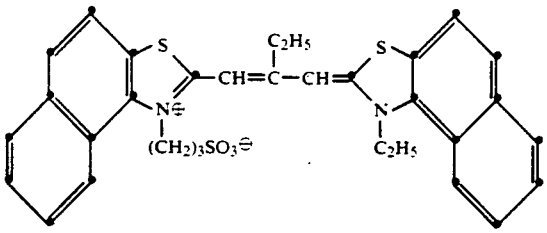
(15)
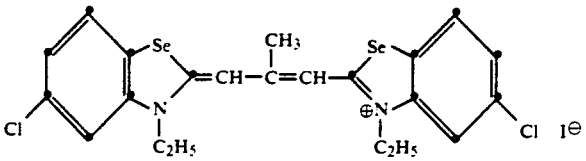
(16)
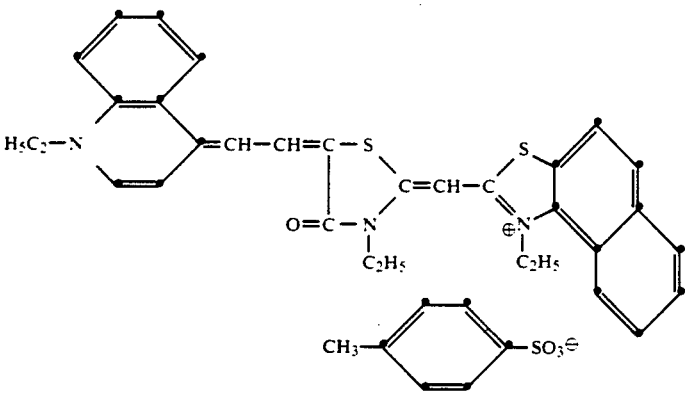
(17)
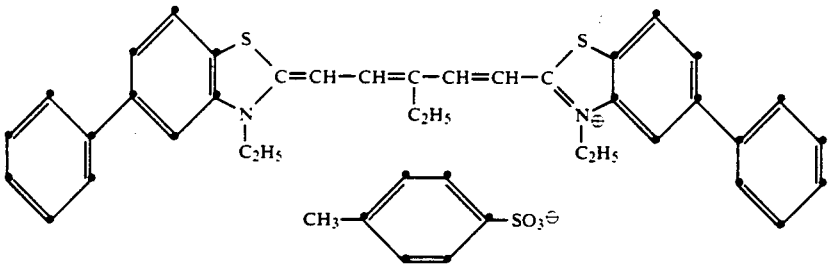
(18)
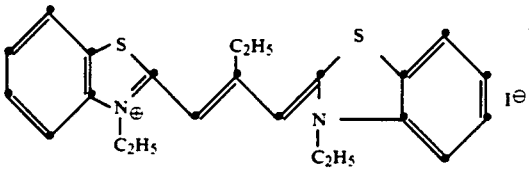
(19)
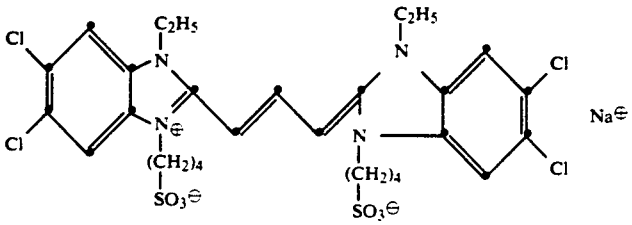

-continued
(20)
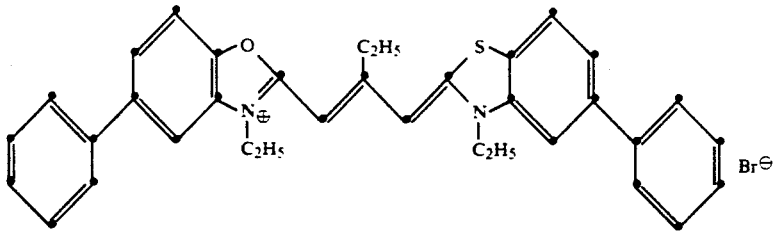
(21)
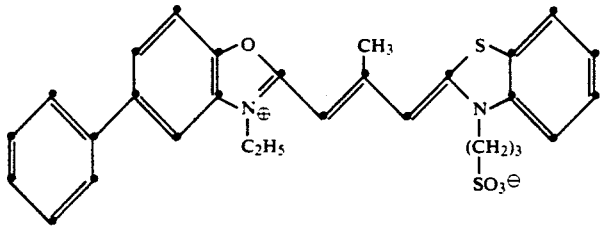
(22)
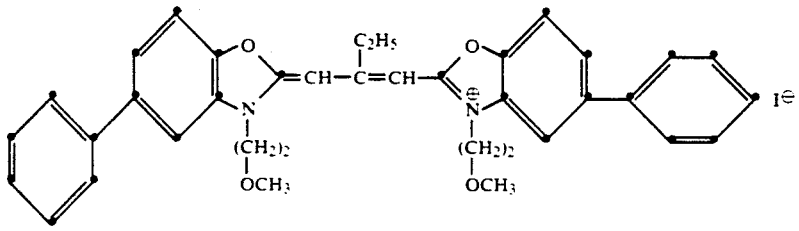
(23)
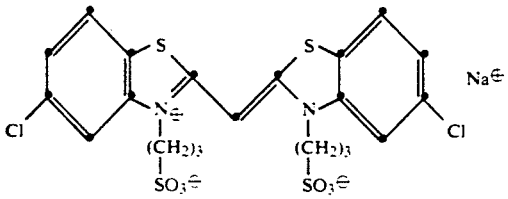
(24)
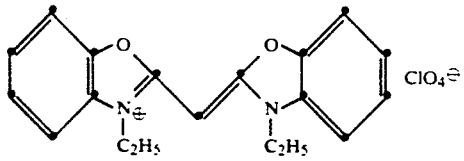
(25)
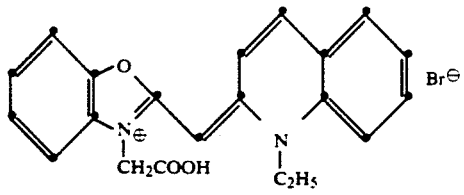
(26)
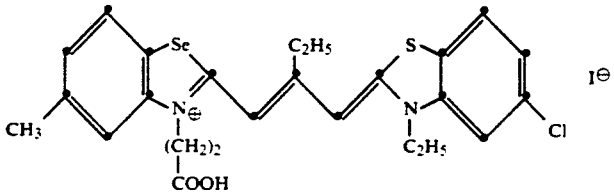

-continued
(27)
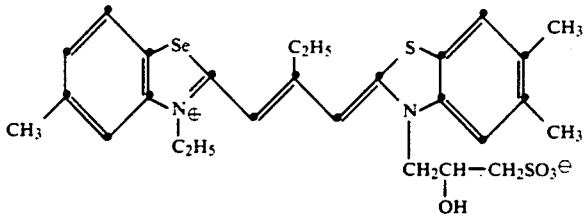
(27a)
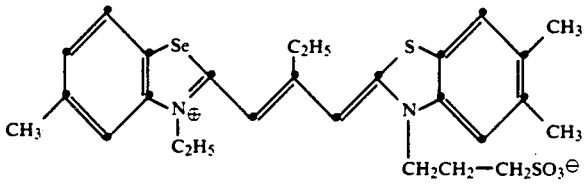
(28)
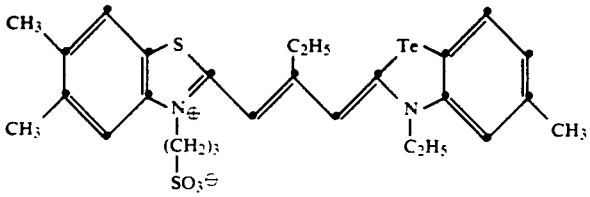
(29)
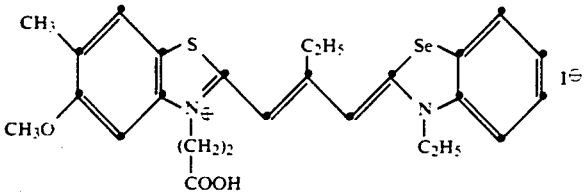
(30)
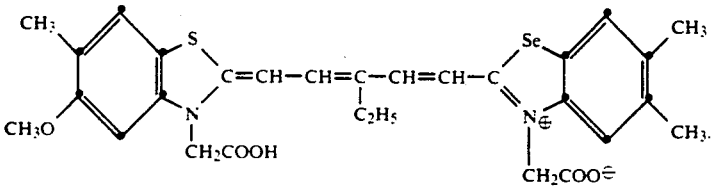
* * * * *